United States Patent [19]

Aoki et al.

[11] 4,333,861

[45] Jun. 8, 1982

[54] THICK FILM VARISTOR

[75] Inventors: Masaki Aoki, Hirakata; Mitsuhiro Ohtani, Sakai, both of Japan

[73] Assignee: Matsushita Electric Industrial Co., Ltd., Japan

[21] Appl. No.: 27,392

[22] Filed: Apr. 5, 1979

Related U.S. Application Data

[63] Continuation of Ser. No. 850,851, Nov. 11, 1977, abandoned.

[30] Foreign Application Priority Data

Nov. 26, 1976 [JP] Japan ..... 51-142450

[51] Int. Cl.[3] ..... H01B 1/06

[52] U.S. Cl. ..... 252/518; 252/519; 252/520; 252/517; 252/521; 338/21

[58] Field of Search ..... 252/519, 517, 518, 521, 252/520; 338/21, 20; 106/47 R, 63; 428/432

[56] References Cited

U.S. PATENT DOCUMENTS

| | | | |
|---|---|---|---|
| 3,669,907 | 6/1972 | Kohashi et al. | 252/518 |
| 3,725,836 | 4/1973 | Wada et al. | 338/20 |
| 4,041,436 | 8/1977 | Kouchich et al. | 338/21 |
| 4,051,074 | 9/1977 | Asada | 252/518 X |
| 4,065,743 | 12/1977 | Wahlers et al. | 252/518 X |
| 4,215,020 | 7/1980 | Wahlers et al. | 252/518 |

*Primary Examiner*—Joseph L. Schofer
*Assistant Examiner*—J. L. Barr
*Attorney, Agent, or Firm*—Wenderoth, Lind & Ponack

[57] ABSTRACT

A thick film varistor comprising a thick film consisting essentially of 20 to 85 weight percent of tin oxide having an additive such as antimony oxide, and 15 to 80 weight percent of a glass frit such as a zinc barium borate glass. This thick film varistor is advantageous for its high n value (i.e. high voltage dependence of resistivity) and its low varistor voltage (i.e. voltage above which its resistivity abruptly decreases).

7 Claims, 1 Drawing Figure

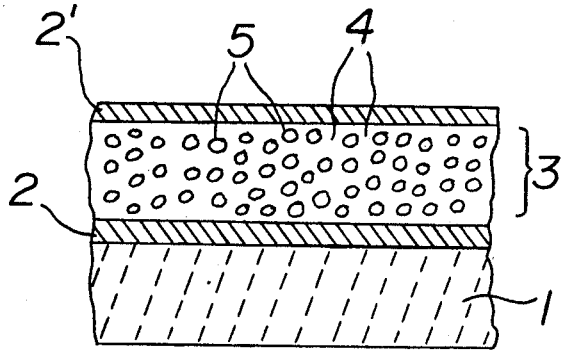
2'
5
4
3
2
1

THICK FILM VARISTOR

This is a continuation, of application Ser. No. 850,851, filed Nov. 11, 1977, now abandoned.

This invention relates to a thick film varistor having finely divided metal oxide particles dispersed in glass.

There have been known various thick film varistors. Usually a varistor is defined as a non-ohmic resistor, the electrical resistance of which varies with the applied voltage. The electric characteristics of a varistor are expressed by the following equation: $I=(V/C)^n$, where V is the voltage across the varistor, I is the current flowing through the varistor, C is a constant equivalent to the electrical resistance at a given voltage and n is a numerical value greater than 1.

It is desired that the C value match with the particular use to which the varistor is to be put. It is ordinarily desirable that the value of n be as large as possible since this exponent determines the degree to which the varistor departs from ohmic characteristics. When the applied voltage exceeds a critical voltage, the current abruptly increases. This critical voltage is called the varistor voltage. Generally the varistor voltage $V_c$ is defined as a voltage at a flowing current of $I_c$ milliampere through the varistor. The varistor voltage referred to hereinafter is a voltage at 10 milliamperes of flowing current. The value of n is calculated from the following equation (1):

$$n=[\log(I_2/I_1)/\log(V_2/V_1)] \quad (1)$$

where $V_1$ and $V_2$ are the voltages at the currents $I_1$ and $I_2$ respectively.

U.S. Pat. No. 3,725,836 teaches a thick film varistor comprising a thick film consisting essentially of 30 to 95 weight percent of finely divided particles of zinc oxide (ZnO) dispersed in 5 to 70 weight percent of glass frit, wherein the zinc oxide has incorporated therein 0.1 to 8 mole percent of bismuth oxide, lead oxide or barium oxide. However, its varistor voltage is not sufficiently low as to match the so-called integrated circuits which recently and remarkably have been developed. The electronic industry has generated a great demand for a thick film varistor having a low varistor voltage as well as a high n value for use, for example, in integrated circuits and in surge suppressors for a micromotor.

Therefore, a principal object of this invention is to provide a thick film varistor having a low varistor voltage as well as a high n value.

This object is achieved according to this invention by providing a thick film varistor comprising a thick film consisting essentially of 20 to 85 weight percent of finely divided particles of tin oxide dispersed in 15 to 80 weight percent of glass frit, the tin oxide having incorporated therein 0.1 to 15 weight percent of one additive selected from the group consisting of antimony oxide($Sb_2O_3$), antimony fluoride($SbF_3$), bismuth oxide($Bi_2O_3$), cobalt oxide($Co_2O_3$), cuprous oxide($Cu_2O$), vanadium oxide($V_2O_5$), molybdenum oxide($MoO_3$), tungsten oxide($WO_3$), zirconium oxide($ZrO_2$), zinc oxide(ZnO), indium oxide($In_2O_3$), thorium oxide($ThO_2$), titanium oxide($TiO_2$), manganese oxide($MnO_2$), niobium oxide($Nb_2O_5$), tantalum oxide($Ta_2O_5$) and phosphorus oxide($P_2O_5$). This thick film varistor has a lower varistor voltage than that of a conventional thick film varistor having a similar n-value, and is more stable with respect to the varistor voltage to a load test than is the conventional thick film varistor. The thick film varistor can be made by preparing a paste of tin oxide particles, the frit, and a liquid vehicle, applying the paste to an insulating refractory base, heating the paste to evaporate the liquid vehicle and then melating the glass frit to bond the particles of tin oxide together, and thereafter applying electrodes to the thus made film. Alternatively, one electrode can be applied to the insulating base before the application of the thick film thereon, the other second electrode being applied to the surface of the thick film.

Other objects and further features of this invention will be apparent upon consideration of the following detailed description taken together with the accompanying drawings, wherein:

The single FIGURE is a cross section, on a greatly enlarged and a highly exaggerated scale, of a thick film varistor according to this invention.

Referring to the FIGURE, a thick film 3 having finely divided particles of tin oxide 5 dispersed in a glass frit 4 is sandwiched between two electrodes 2 and 2' one of which is formed on an insulating refractory base 1. In this structure, the electrode 2 formed on the insulating base may be replaced by a suitable and available metal plate such as silver, platinum, titanium, gold and nickel.

A method for making a thick film varistor contemplated by this invention comprises the following steps: providing a varistor paste having finely divided particles of tin oxide and finely divided particles of glass frit, as solid ingredients, dispersed in a liquid vehicle; applying the varistor paste to an insulating refractory base; heating the applied varistor paste to evaporate the liquid vehicle and to melt the finely divided particles of glass frit so that the melted glass frit bonds said finely divided particles of tin oxide together to form a thick film; and providing two electrodes to the thick film. This method can be modified in the following way. The varistor paste is applied to an electrode preliminarily formed on an insulating base or to a metal plate acting as an electrode. The subsequent steps are similar to those mentioned above.

The varistor paste can be prepared by homogeneously dispersing a uniform mixture of a glass frit powder and a tin oxide powder, as solid ingredients, in a liquid vehicle. The preferred weight proportion of the tin oxide powder to the glass frit powder in the mixture is 20 to 85 wt. % of tin oxide and 15 to 80 wt. % of glass frit powder. The liquid vehicle may vary widely in composition. Any inert liquid can be employed for this purpose, for example, water, organic solvents, with or without thickening agents, stabilizing agents, or the like, such as methyl, ethyl, butyl, propyl or higher alcohols, pine oil, alpha-terpeneol, and the like, and the corresponding esters such as the carbitol acetates, propionates etc., the terpenes and liquid resins. The liquid vehicles may further contain volatile liquids to promote fast setting after application, or they may contain waxes, thermoplastic resins such as cellulose acetate butyrate, or wax-like materials which are thermofluid by nature whereby the composition can be applied to the insulating base.

The amount of the liquid vehicle relative to the solid ingredient can vary with the variation in the manner of applying the varistor paste to the insulating base or the electrode surface. For example, in a stencil screen printing method, a preferred composition of the varistor paste comprises 10 to 45 wt. % of liquid vehicle and 55 to 90 wt. % of solid ingredient. A more preferred composition is 15 to 30 wt. % of liquid vehicle and 70 to 85 wt. % of the ingredient. It is preferred that the viscosity of the resultant paste be 500 to 2,000 poises. The varistor paste is applied to a uniform thickness to the insulating base or to the electrode surface. This may be done by any application method. The varistor paste applied to the insulating base is dried, if necessary, to remove the liquid vehicle and then fired in an electrical furnace at a temperature at which the glass frit fuses so as to bond the tin oxide powder particles and to make the varistor film firmly adhere to the insulating base. The firing temperature may vary with the composition of glass frit. It is preferred to adjust the firing temperature to 500° to 900° C.

Finely divided tin oxide powder is prepared by pulverization of sintered tin oxide which is heated at a temperature of 1000° to 1500° C. for 0.5 to 10 hours. The pulverization of tin oxide powder can be achieved in accordance with well known techniques. The sintered tin oxide may be pre-crushed into granules having a diameter of few millimeters by a crushing machine equipped with a steel or iron pestle and mortar. The granules are further pulverized into fine powder with a fine crusher such as a ball mill or vibration mill etc. The preferred average particle size of the tin oxide powder is 0.1 to 15 microns.

It has been discovered according to this invention that the varistor voltage is lowered when the tin oxide powder has incorporated therein 0.1 to 15 weight percent of one member selected from the group consisting of antimony oxide ($Sb_2O_3$), antimony fluoride ($SbF_3$), bismuth oxide ($Bi_2O_3$), cobalt oxide ($Co_2O_3$), cuprous oxide ($Cu_2O$), vanadium oxide ($V_2O_5$), molybdenum oxide ($MoO_3$), tungsten oxide ($WO_3$), zirconium oxide ($ZrO_2$), zinc oxide (ZnO), indium oxide ($In_2O_3$), thorium oxide ($ThO_2$), titanium oxide ($TiO_2$), manganese oxide ($MnO_2$), niobium oxide ($Nb_2O_5$), tantalum oxide ($Ta_2O_5$) and phosphorus oxide ($P_2O_5$). According to this invention, the n-value is elevated when the tin oxide powder consists essentially of 80 to 99.85 weight percent of tin oxide, 0.1 to 10.0 weight percent antimony oxide and 0.05 to 10.0 weight percent, in total, of at least one member selected from the group consisting of cobalt oxide, manganese oxide, bismuth oxide and chromium oxide. A mixture of the tin oxide powder and the additives of a given composition is heated at a high temperature of 1000° to 1500° C. and then crushed into fine powder in a manner similar to that described above.

Preferred glass frits for use in the varistor paste are borosilicate glass, bismuth borosilicate glass, zinc barium borate glass and zinc antimony barium borate glass. A more preferred glass frit is zinc antimony barium borate frit having a composition consisting essentially of 10 to 40 wt. % of BaO, 30 to 45 wt. % of $B_2O_3$, 15 to 40 wt. % of ZnO and 0.1 to 10 wt. % of $Sb_2O_3$. The glass frit can be prepared in accordance with a per se well known glass frit technique. A mixture including the desired starting materials is heated to a high temperature so as to form a glass frit and is quenched in water. The quenched glass frit is pulverized into powder having a desired particle size by using, for example, a wet ball mill. An advantageous average particle size for the particles of the glass frit is 0.5 to 15 microns.

The electrodes 2 and 2' may be formed by any suitable and available method, for example, evaporating or metallizing silver, gold, platinum, aluminum, copper and nickel. It has been discovered according to this invention that a higher n is obtained by using a silver paint electrode which has finely divided particles of silver dispersed in a bonding glass. Care should be taken that the softening temperature of the bonding glass is not higher than that of the glass frit of the varistor paste. The silver paint is prepared by dispersing a mixture of silver powder and a bonding glass frit powder in a liquid vehicle. This mixture is preferably composed of 60 to 98 wt. % of the silver powder and 2 to 40 wt. % of the bonding glass frit powder. Preferred composition of the bonding glass frit powder is 60 to 80 wt. % of bismuth oxide, 10 to 20 wt. % of boron oxide and 10 to 20 wt. % of zinc oxide. The method of preparing the silver paint is essentially similar to that for the varistor paste mentioned above.

The following examples are given to illustrate certain preferred details of this invention, it being understood that the details of the examples are not to be taken as in any way limiting the invention thereto.

EXAMPLE 1

Tin oxide powder was heated at a temperature of 1350° C. for 1 hour and was pulverized into fine powder having an average particle size of 5 microns by a ball mill. Glass frit block having a composition of 35 wt. % of BaO, 40 wt. % of $B_2O_3$, 20 wt. % of ZnO and 5 wt. % of $Sb_2O_3$ was pulverized into a fine powder having an average particle size of 3 microns. 75 wt. % of the thus made tin oxide powder and 25 wt. % of the thus made glass frit were uniformly mixed, and 80 weight parts of this mixture was well mixed with 20 weight parts of a liquid vehicle consisting of 10 wt. % of ethyl cellulose and 90 wt. % of alphaterpeneol to form a varistor paste.

A silver paint commercially available as No. 6730 from Dupont Co. in the U.S.A., was applied to an aluminum oxide ceramic base by a stainless steel screen stencil with a 250 mesh (which pass particles having a diameter smaller than 72 microns) and was fired in air at 850° C. for 10 minutes by a tunnel type kiln so as to form a silver paint electrode. The varistor paste was applied to the silver paint electrode and was fired in air at 850° C. for 5 minutes by the tunnel kiln. The resultant thick film had a thickness of 30 microns. The silver paint for the other electrode was again applied to the varistor film and was fired at 800° C. in a manner similar to that described above to form an upper silver paint electrode having an active area of $3\times3$ mm$^2$.

The thus made sample thick film varistor is Sample No. 1 in Table 1, and had electrical properties shown in Table 1. In Table 1, exponent n was calculated from the equation (1) by using $I_1=1$ mA, and $I_2=10$ mA, and $V_c$ was the varistor voltage at the current $I_c=10$ mA. By varying the weight ratios between tin oxide and the glass frit, and by varying the composition of the glass frit, five more samples (Sample Nos. 2 to 6) were made. Table 1 shows the electrical properties of these samples too.

EXAMPLE 2

Tin oxide powders with additives listed in Table 2 were fabricated into thick film varistors by the same process as that of Example 1. The glass frit used here was the same as that for Sample No. 1. The solid ingredients had 50 weight percent of tin oxide and 50 weight percent of the glass frit. The thickness was 30 mirons as in Example 1. The resultant electrical properties are shown in Table 2, in which each value of n was the n-value defined between 1 mA and 10 mA as in Example 1. It can be easily understood that the addition of antimony oxide, antimony fluoride, bismuth oxide, cobalt oxide, cuprous oxide, vanadium oxide, molybdenum oxide, tungsten oxide, zirconium oxide, zinc oxide, indium oxide, thorium oxide, titanium oxide, manganese oxide, niobium oxide, tantalum oxide or phosphorus oxide as an additive causes the low varistor voltage.

EXAMPLE 3

Tin oxide powders with additives listed in Table 3 were fabricated into thick film varistors by the same process as that of Example 1. The glass frit used here was the same as that for Sample No. 1. The solid ingredients had 50 weight percent of tin oxide and 50 weight percent of the glass frit. The thickness was 30 microns as in Example 1. The resultant electrical properties are shown in Table 3, in which each value of n is the n-value defined between 1 mA and 10 mA as in Example 1. It can be easily understood that the combined addition of antimony oxide and one member selected from the group consisting of cobalt oxide, manganese oxide, bismuth oxide and chromium oxide as additives causes higher n-values.

TABLE 1

| Sample No. | Tin oxide (wt. %) | Glass frit (wt. %) | Composition of glass frit (wt. %) ZnO | $Sb_2O_3$ | BaO | $B_2O_3$ | Varistor voltage $V_c$ (at 10 mA) | Nonlinear exponent n |
|---|---|---|---|---|---|---|---|---|
| 1 | 25 | 75 | 20 | 5 | 35 | 40 | 10 | 3.5 |
| 2 | 40 | 60 | 20 | 5 | 35 | 40 | 8.5 | 3.8 |
| 3 | 50 | 50 | 20 | 5 | 35 | 40 | 7.2 | 4.0 |
| 4 | 50 | 50 | 40 | 5 | 10 | 45 | 7.5 | 4.0 |
| 5 | 50 | 50 | 20 | 10 | 40 | 30 | 8.0 | 3.9 |
| 6 | 70 | 30 | 25 | 5 | 30 | 40 | 7.5 | 3.5 |

TABLE 2

| Sample No. | Additives in $SnO_2$ (wt. %) | | | | | | | | | Varistor Voltage $V_c$ (at 10 mA) | Nonlinear exponent n |
|---|---|---|---|---|---|---|---|---|---|---|---|
| | $Sb_2O_3$ | $SbF_3$ | $Bi_2O_3$ | $Co_2O_3$ | $Cu_2O$ | $V_2O_5$ | $MoO_3$ | $WO_3$ | $ZrO_2$ | | |
| 7 | 0.1 | | | | | | | | | 7.0 | 4.1 |
| 8 | 5 | | | | | | | | | 6.5 | 4.4 |
| 9 | | 0.1 | | | | | | | | 6.8 | 4.2 |
| 10 | | 5 | | | | | | | | 6.4 | 4.6 |
| 11 | | | 0.1 | | | | | | | 7.1 | 4.2 |
| 12 | | | 5 | | | | | | | 6.7 | 4.4 |
| 13 | | | | 0.1 | | | | | | 7.2 | 4.5 |
| 14 | | | | 5 | | | | | | 7.0 | 4.8 |
| 15 | | | | | 0.1 | | | | | 6.6 | 4.2 |
| 16 | | | | | 5 | | | | | 6.3 | 4.5 |
| 17 | | | | | | 0.1 | | | | 6.5 | 4.2 |
| 18 | | | | | | 5 | | | | 6.4 | 4.5 |
| 19 | | | | | | | 0.1 | | | 6.3 | 4.4 |
| 20 | | | | | | | 5 | | | 6.2 | 4.6 |
| 21 | | | | | | | | 0.1 | | 6.3 | 4.5 |
| 22 | | | | | | | | 5 | | 6.4 | 4.2 |
| 23 | | | | | | | | | 0.1 | 5.4 | 5.6 |
| 24 | | | | | | | | | 5 | 5.6 | 5.5 |
| | ZnO | $In_2O_3$ | $ThO_2$ | $TiO_2$ | $MnO_2$ | $Nb_2O_5$ | $Ta_2O_5$ | | $P_2O_5$ | | |
| 25 | 0.1 | | | | | | | | | 7.1 | 4.2 |
| 26 | 5 | | | | | | | | | 6.5 | 4.3 |
| 27 | | 0.1 | | | | | | | | 7.2 | 4.1 |
| 28 | | 5 | | | | | | | | 7.0 | 4.2 |
| 29 | | | 0.1 | | | | | | | 5.4 | 5.5 |
| 30 | | | 5 | | | | | | | 5.2 | 5.5 |
| 31 | | | | 0.1 | | | | | | 5.8 | 4.3 |
| 32 | | | | 5 | | | | | | 5.6 | 4.5 |
| 33 | | | | | 0.1 | | | | | 7.0 | 4.2 |
| 34 | | | | | 5 | | | | | 6.9 | 4.5 |
| 35 | | | | | | 0.1 | | | | 5.9 | 4.4 |
| 36 | | | | | | 5 | | | | 5.8 | 4.7 |
| 37 | | | | | | | 0.1 | | | 6.0 | 4.5 |
| 38 | | | | | | | 5 | | | 5.8 | 4.7 |
| 39 | | | | | | | | | 0.1 | 5.3 | 4.8 |
| 40 | | | | | | | | | 5 | 5.4 | 4.2 |

TABLE 3

| Sample No. | Additives (wt. %) $Sb_2O_3$ | $Co_2O_3$ | $MnO_2$ | $Bi_2O_3$ | $Cr_2O_3$ | Varistor voltage $V_c$ (at 10 mA) | Nonlinear exponent n |
|---|---|---|---|---|---|---|---|
| 41 | 0.1 | 0.05 | | | | 7.1 | 5.2 |
| 42 | 0.1 | 10 | | | | 7.6 | 6.2 |
| 43 | 0.1 | | 0.05 | | | 6.9 | 6.1 |
| 44 | 0.1 | | 10 | | | 7.2 | 6.5 |
| 45 | 0.1 | | | 0.05 | | 7.2 | 5.9 |
| 46 | 0.1 | | | 10 | | 7.5 | 5.7 |
| 47 | 0.1 | | | | 0.05 | 7.3 | 6.1 |
| 48 | 0.1 | | | | 10 | 7.8 | 6.3 |
| 49 | 5 | 0.05 | | | | 6.8 | 5.4 |
| 50 | 5 | 5 | | | | 6.5 | 6.5 |
| 51 | 5 | | 0.05 | | | 6.3 | 6.3 |
| 52 | 5 | | 5 | | | 6.5 | 7.0 |
| 53 | 5 | | | 0.05 | | 6.9 | 6.2 |
| 54 | 5 | | | 5 | | 7.1 | 6.4 |
| 55 | 5 | | | | 0.05 | 7.0 | 6.3 |

TABLE 3-continued

| Sample No. | Additives (wt. %) $Sb_2O_3$ | $Co_2O_3$ | $MnO_2$ | $Bi_2O_3$ | $Cr_2O_3$ | Varistor voltage $V_c$ (at 10 mA) | Nonlinear exponent n |
|---|---|---|---|---|---|---|---|
| 56 | 5 | | | | 5 | 7.1 | 6.8 |
| 57 | 10 | 5 | | | | 7.2 | 6.5 |
| 58 | 10 | 10 | | | | 7.5 | 6.3 |
| 59 | 10 | | 5 | | | 7.0 | 6.9 |
| 60 | 10 | | 10 | | | 7.3 | 6.2 |
| 61 | 10 | | | 5 | | 7.3 | 6.3 |
| 62 | 10 | | | 10 | | 7.9 | 6.0 |
| 63 | 10 | | | | 5 | 7.2 | 6.2 |
| 64 | 10 | | | | 10 | 7.5 | 6.0 |

What is claimed is:

1. A thick film varistor comprising a thick film consisting essentially of 20 to 85 weight percent of finely divided particles of tin oxide dispersed in 15 to 80 weight percent of glass frit, said glass frit being a zinc antimony barium borate glass consisting essentially of 15 to 40 weight percent of ZnO, 0.1 to 10 weight percent of $Sb_2O_3$, 10 to 40 weight percent of BaO and 30 to 45 weight percent of $B_2O_3$, said tin oxide having incorporated therein an additive selected from 0.1 to 15 weight percent of one of vanadium oxide ($V_2O_5$), molybdenum oxide ($MoO_3$), zirconium oxide ($ZrO_2$), indium oxide ($In_2O_3$), thorium oxide ($ThO_2$) or phosphorus oxide ($P_2O_5$).

2. The thick film varistor according to claim 1, comprising a thick film consisting essentially of 20 to 85 weight percent of finely divided particles of tin oxide dispersed in 15 to 80 weight percent of glass frit, said glass frit being a zinc antimony barium borate glass consisting essentially of 15 to 40 weight percent of ZnO, 0.1 to 10 weight percent of $Sb_2O_3$, 10 to 40 weight percent of BaO and 30 to 45 weight percent of $B_2O_3$, said tin oxide having incorporated therein 0.1 to 15 weight percent of vanadium oxide ($V_2O_5$).

3. The thick film varistor according to claim 1, comprising a thick film consisting essentially of 20 to 85 weight percent of finely divided particles of tin oxide dispersed in 15 to 80 weight percent of glass frit, said glass frit being zinc antimony barium borate glass consisting essentially of 15 to 40 weight percent of ZnO, 0.1 to 10 weight percent of $Sb_2O_3$, 10 to 40 weight percent of BaO and 30 to 45 weight percent of $B_2O_3$, said tin oxide having incorporated therein 0.1 to 15 weight percent of molybdenum oxide ($MoO_3$).

4. The thick film varistor according to claim 1, comprising a thick film consisting essentially of 20 to 85 weight percent of finely divided particles of tin oxide dispersed in 15 to 80 weight percent of glass frit, said glass frit being a zinc antimony barium borate glass consisting essentially of 15 to 40 weight percent of ZnO, 0.1 to 10 weight percent of $Sb_2O_3$, 10 to 40 weight percent of BaO and 30 to 45 weight percent of $B_2O_3$, said tin oxide having incorporated therein 0.1 to 15 weight percent of zirconium oxide ($ZrO_2$).

5. The thick film varistor according to claim 1, comprising a thick film consisting essentially of 20 to 85 weight percent of finely divided particles of tin oxide dispersed in 15 to 80 weight percent of glass frit, said glass frit being a zinc antimony barium borate glass consisting essentially of 15 to 40 weight percent of ZnO, 0.1 to 10 weight percent of $Sb_2O_3$, 10 to 40 weight percent of BaO and 30 to 45 weight percent of $B_2O_3$, said tin oxide having incorporated therein 0.1 to 15 weight percent of indium oxide ($In_2O_3$).

6. The thick film varistor according to claim 1, comprising a thick film consisting essentially of 20 to 85 weight percent of finely divided particles of tin oxide dispersed in 15 to 80 weight percent of glass frit, said glass frit being a zinc antimony barium borate glass consisting essentially of 15 to 40 weight percent of ZnO, 0.1 to 10 weight percent of $Sb_2O_3$, 10 to 40 weight percent of BaO and 30 to 45 weight percent of $B_2O_3$, said tin oxide having incorporated therein 0.1 to 15 weight percent of thorium oxide ($ThO_2$).

7. The thick film varistor according to claim 1, comprising a thick film consisting essentially of 20 to 85 weight percent of finely divided particles of tin oxide dispersed in 15 to 80 weight percent of glass frit, said glass frit being a zinc antimony barium borate glass consisting essentially of 15 to 40 weight percent of ZnO, 0.1 to 10 weight percent of $Sb_2O_3$, 10 to 40 weight percent of BaO and 30 to 45 weight percent of $B_2O_3$, said tin oxide having incorporated therein 0.1 to 15 weight percent of phosphorus oxide ($P_2O_5$).

* * * * *